United States Patent [19]

Aspenwall

[11] 4,156,980

[45] Jun. 5, 1979

[54] BREECH OPENING APPARATUS FOR HANDGUN

[76] Inventor: John E. Aspenwall, 1327 E. Madrid Way, Sandy, Utah 84070

[21] Appl. No.: 870,866

[22] Filed: Jan. 20, 1978

[51] Int. Cl.[2] ..... F41C 11/08

[52] U.S. Cl. ..... 42/44

[58] Field of Search ..... 42/44, 45, 40, 63, 64, 42/8

[56] References Cited

U.S. PATENT DOCUMENTS

| | | | |
|---|---|---|---|
| 1,507,411 | 9/1924 | Zugaja | 42/44 |
| 3,561,149 | 2/1971 | Center | 42/44 |

*Primary Examiner*—Charles T. Jordan

*Attorney, Agent, or Firm*—Criddle, Thorpe & Western

[57] ABSTRACT

In a handgun having a spring biased breech locking mechanism and pistol grip handle, a breech release device mounted at the butt of the pistol grip handle to provide breech release access without disturbing the grip of the shooter's hand grasp. The device includes a base member which is fixed within the handle to the handgun receiver. Linkage means are attached at the remote end of said base member to permit coupling thereto of a lever means located at the butt of the handle. A connecting rod extends from a remote end of the lever means and engages the breech locking mechanism of the handgun. Contact between the connecting rod end and breech locking mechanism is maintained by the spring biasing force applied to the breech locking mechanism. By displacing the lever means, the connecting rod is extended and disengages the spring biased breech locking mechanism.

5 Claims, 3 Drawing Figures

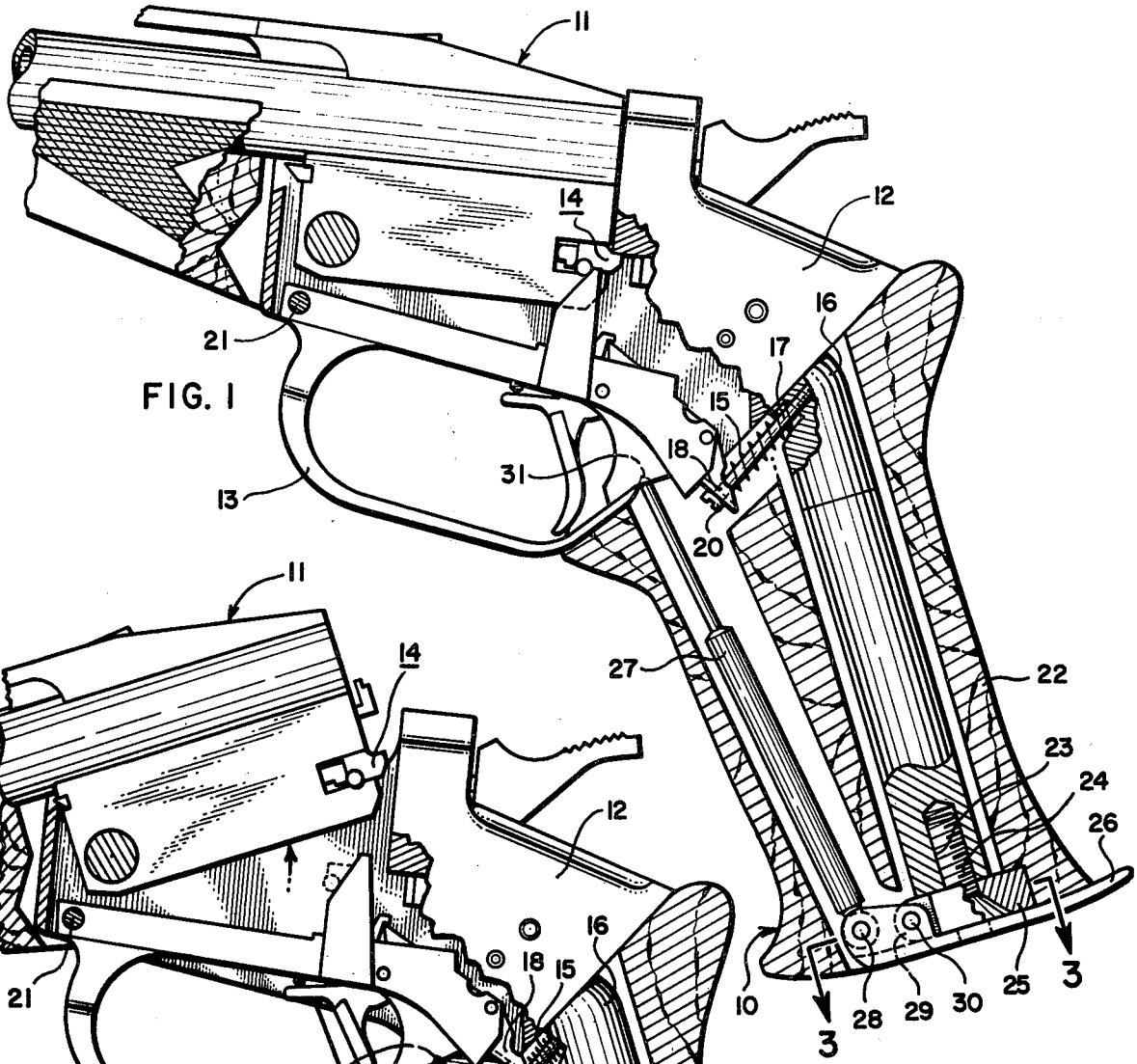
FIG. 1
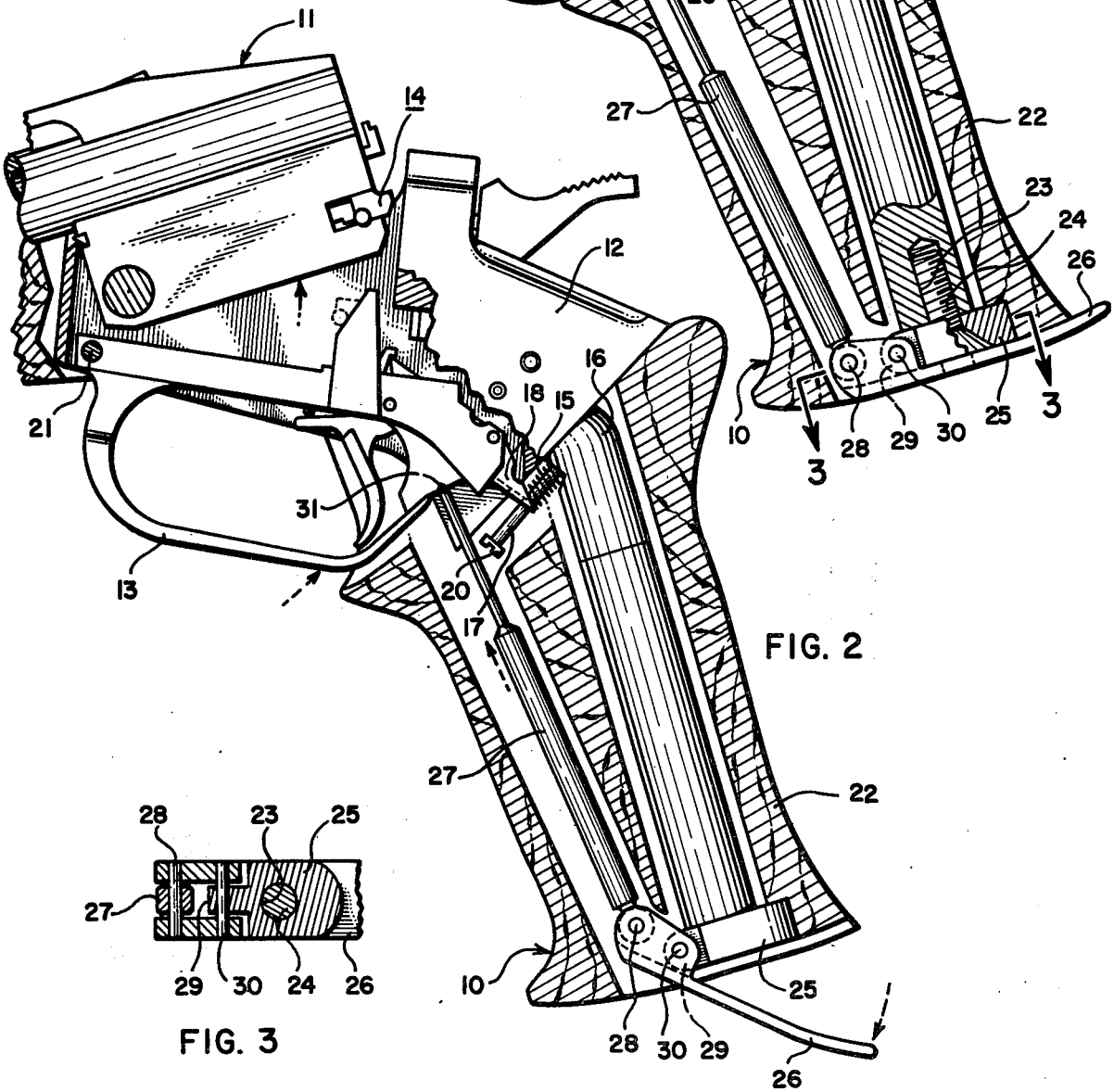
FIG. 2
FIG. 3

BREECH OPENING APPARATUS FOR HANDGUN

BACKGROUND OF THE INVENTION

1. Field of the Invention

This invention relates to a breech opening mechanism for handguns having spring biased breech locking mechanisms. More particularly, the invention pertains to handguns wherein the breech locking mechanism includes the trigger guard assembly which may be distended to release a breech locking latch.

2. Prior Art

Numerous mechanisms have been adapted for releasing a breech locking device which retains the barrel in firing alignment with the firing pin and hammer assembly. Typically, the form of breech release is adapted to meet the particular need of the handgun user. Such uses may extend from quick loading capability to high accuracy tournament shooting.

Where the primary purpose of handgun use is for accuracy over a multiple firing sequence, the user is particularly conscious of maintaining a consistent and stable hand grip on the weapon. It will be apparent to those skilled in the art that variations of grip during a shooting sequence disrupt the target alignment along the line of sight of the shooter and greatly hamper consistency.

Since the primary objective of tournament shooting is accuracy, many shooters prefer to use a breech loading handgun because of the absence of a rotating chamber and other moving parts which can hamper projectile positioning and alignment. The conventional method for breech loading such handguns involves the use of a spring biased trigger guard assembly which connects to a latch which locks the handgun in a breech-closed position. To release the latch, the trigger guard assembly is depressed into the receiver, releasing the latch and permitting the breech to open. To facilitate this movement, the trigger guard assembly usually has an elongate tang extending downward from the trigger guard which is adapted for grasping by the shooter. The length of the tang gives leverage to facilitate easier opening of the breech.

The tang-release device permits the user to retain a partial grip on the handle; however, the user is usually required to squeeze the tang toward the handle with both hands in order to apply sufficient pressure to release the locking mechanism. As a consequence, it is not uncommon for the squeezing action to displace the hand grip and thereby affect accuracy.

OBJECTS AND SUMMARY OF THE INVENTION

It is therefore an object of the present invention to provide a breech release mechanism for use with handguns which permits the user to maintain a firm hand grasp during the entire shooting sequence.

It is a further object of the present invention to provide a breech release mechanism which can be actuated at the butt of the pistol grip.

It is yet another object of the present invention to provide a lever release mechanism which decreases the force required to release the breech locking latch.

It is a still further object of this invention to provide a breech release mechanism located within the handle of the handgun to add stability and balance to the handgun structure.

An additional object of this invention is to provide a breech opening mechanism which does not require the use of a tang structure in connection with the trigger guard assembly.

These objects are realized in a butt-mounted release lever assembly which comprises a base member which extends through the handle of the handgun and has linkage means attached at the remote end for coupling to a lever means situated at the butt of the handle. Also attached to the lever means is a connecting rod which extends from the remote end of the lever means to the spring biased breech locking mechanism of the handgun. As the lever means is extended, the connecting rod pushes the spring biased breech locking mechanism into the unlatched position, thereby opening the breech of the handgun. Because of improved leverage and location, the lever can be actuated with a single hand, without removing or disturbing the firing hand from a firing grip. Other objects and features will be obvious to a person skilled in the art from the following detailed description, taken with the accompanying drawings, which are as follows:

FIG. 1 shows a partial cutaway view of the subject breech release mechanism, in combination with a receiver and trigger assembly of a handgun.

FIG. 2 is a partial cutaway view illustrating the position of the breech release mechanism upon full displacement of the butt mounted lever.

FIG. 3 is a cross section taken along line 3—3 of FIG. 1.

DETAILED DESCRIPTION OF THE INVENTION

Referring now to the drawings:

A preferred embodiment of the subject invention is mounted in the pistol grip handle 10 of a handgun 11 shown generally. The illustrated handgun includes a receiver 12 which partially houses a trigger and trigger guard assembly 13. The barrel assembly includes a breech locking latch 14 which retains the barrel assembly in firing position. The latch 14 is cammed forward to an unlatched position by displacement of the trigger guard assembly 13 into the receiver 12.

The trigger guard assembly 13 is spring biased at the closed position by means of a spring 15 which extends from a base member or post 16 which is immovably coupled to the receiver 12. A mounting pin 17 supports the biasing spring 15 and is connected to the post 16 as shown. A slotted flange 18 extends rearward from the trigger assembly 13, and retains the mounting pin therein. The pin head 20 is positioned on the remote side of the slotted flange 18 to limit the extent of movement of the flange and attached receiver in response to the spring 15.

When the spring biased trigger guard assembly and attached breech locking latch are in the closed position (FIG. 1), the slotted flange 18 is biased against the pin head 20. To release the breech of the handgun, the trigger guard assembly 13 is slightly rotated into the receiver 12 about a pivot point 21 formed by a movable pin inserted through the receiver and trigger guard assembly.

In the present invention, the rotation of the spring biased trigger assembly is accomplished by means of a butt-mounted release lever assembly which is housed in the pistol grip 22 attached at post 16 extending from the receiver. Since this post 16 also functions as a base member to support the butt-mounted release lever assembly, it is shown extending the full length of the pistol grip.

The remote end of the post 16 has a flat surface and threaded hole 23 for receiving a mounting screw 24. This mounting screw 24 is utilized to attach linkage means 25 at the flat surface of said post. A primary function of said linkage means 25 is to enable pivotal mounting of a lever 26 thereto which has a connecting rod 27 coupled at the working end 28 of said lever.

Numerous linkage means may be suitable to accomplish the object of the present invention; however, a small block of metal with a finger extension 29 for receiving a pivotal pin 30 in concert with a slotted fulcrum point on said lever 26 provides the strength and stability desired. Since only a short rotation of the trigger guard assembly is necessary to release the breech locking latch 14, the pivotal pin 30 is positioned near the working end of the lever to develop maximum leverage.

A connecting rod 27 attaches at the remote end 28 of the lever and extends to contact the trigger guard assembly at a contact point 31. As indicated, the leverage force developed when the lever 26 is pulled downward is transmitted through the extending connecting rod 27 to the recessed contact point 31 on the breech lock mechanism. In the illustrated embodiment, this recessed point is located near the rearward base of the trigger guard assembly and receives the remote end of the connecting rod 27 therein. Contact by the connecting rod within this recessed area is maintained by the spring biasing force which retains the breech locking mechanism in the closed position.

In view of the angular motion at the working end of the lever 28, it is preferred that the connecting rod be attached thereto by means which permit pivotal movement of the connecting rod as the lever is displaced through its angular rotation. As disclosed herein, therefore, the lever includes the first pivotal point of attachment at the fulcrum location 30 and a second point of attachment 28 which is preferably pivotal and may be accomplished by a slotted pin arrangement as illustrated. It will also be apparent that the length of the connecting rod must be specifically structured such that the remote end of the connecting rod rests in the recessed section of the breech locking mechanism in the closed position.

The benefits of this novel structure for releasing the breech in a hand loading pistol are illustrated in the following example. During a sequence of firing, the weapon is loaded and a suitable firing grip is secured about the handle and trigger assembly. After firing the weapon, the user retains his grip about the handle and with his nonfiring hand, pulls down on the remote end of the lever 26. As the lever is pulled downward, the connecting rod 27 extends upward forcing the trigger guard assembly 13 to rotate along the same direction. The biasing spring 17 is thereby depressed and the breech locking latch 14 releases, permitting the breech to open. The user removes the spent cartridge and inserts a new round, closing the breech. He is now prepared to discharge the newly loaded round, having the retained pistol grip position from the first firing sequence.

Because of the increased leverage offered by the butt-mounted release lever assembly, less strength is required to disengage the breech locking latch. Since less strength is reguired, possible dislocation of the firing hand grip is avoided because of the reduced strain during breech opening procedures. Also eliminated are the disadvantages of having an extended tang protruding from the base of the trigger guard assembly. Instead, the breech lever release mechanism is totally contained within the handle 22 and does not encumber the use of the weapon. The elimination of the tang further facilitates an unobstructed, conventional two-handed grip.

Since the butt mounted release lever assembly and connecting rod are housed substantially within the pistol grip, it is apparent that the stock of the handle must be bored with two openings to receive the respective base member or post 16 and connecting rod 27 therethrough. The handle can be secured to the receiver 12 by means of the same mounting screw 24 as used for the linkage means. This may be accomplished by using the extended sides of the linkage means around the post as a retaining shoulder against a contacting portion of the butt of the stock thereat.

It will be apparent that the structure disclosed by the preferred embodiment herein is only illustrative and should not be considered as the only structure suitable for carrying out the subject invention. Obviously, any base member which is extended to the butt of the pistol grip can serve as a mounting base for the linkage means which is connected to the lever assembly. In addition, various configurations of levers can be envisioned which implement the inventive concept of transferring leverage force through an attached connecting rod which abuts the breech lock mechanism. It should therefore be understood that the present disclosure is by way of example only and that variations are possible without departing from the scope of the hereinafter claimed subject matter, which subject matter is to be regarded as the invention.

I claim:

1. In a handgun having a spring biased breech locking mechanism, breech, receiver and pistol grip handle, the improvement comprising a butt-mounted release lever assembly including:

a. a base member positioned at the butt of said handle;
b. linkage means attached to the base member near the butt location of said handle;
c. lever means having a first pivotal point of attachment for coupling to said linkage means intermediate to the length of said lever means;
d. a connecting rod having means for attachment at one end thereof to said lever means, the other end of said rod being engaged in contact with said spring biased breech locking mechanism at a contact point such that displacement of said lever extends the connecting rod and breech locking mechanism, thereby releasing said breech.

2. An improved release lever assembly as defined in claim 1, wherein the base member includes a stabilizing post connected to the receiver of said handgun and extending to the butt location of said handle, said linkage means being attached at a remote end of said post from said receiver.

3. An improved release lever assembly as defined in claim 1, wherein said connecting rod is attached at an end of said lever means and said first pivotal point of attachment with said linkage means is located in the same half section of the lever means as said lever means end.

4. An improved release lever assembly as defined in claim 1, wherein the spring biased release mechanism includes a depressible trigger guard assembly which partially rotates into the receiver of the handgun, pivoting about a fixed axis of rotation located at a forward section of said trigger guard assembly, the engaging contact point between said spring biased breech locking mechanism and said connecting rod being located at a lower, rearward section of said trigger guard assembly which is at least partially concealed by said pistol grip handle.

5. An improved release lever assembly as defined in claim 4, wherein said contact point on said trigger guard assembly comprises a recessed contact area for receiving the end of said connecting rod.

* * * * *